US006519816B1

(12) United States Patent
Tagaguchi et al.

(10) Patent No.: US 6,519,816 B1
(45) Date of Patent: Feb. 18, 2003

(54) CONTAINER COUPLING DEVICE

(75) Inventors: Hiroyuki Tagaguchi, Nagasaki (JP); Takao Nomizu, Niigata (JP)

(73) Assignee: Taiyo Seiki Iron Works Co., Ltd., Osaka (JP)

( * ) Notice: Subject to any disclaimer, the term of this patent is extended or adjusted under 35 U.S.C. 154(b) by 0 days.

(21) Appl. No.: 09/939,839

(22) Filed: Aug. 28, 2001

(51) Int. Cl.[7] ..... B65D 21/00; B60P 7/00
(52) U.S. Cl. ..... 24/287; 410/82
(58) Field of Search ..... 24/287; 410/83, 410/82; 403/348; 206/159; 220/1.5, 23.4

(56) References Cited

U.S. PATENT DOCUMENTS 3,753,272 A * 8/1973 Laidley ..... 24/287
3,894,493 A * 7/1975 Strecker ..... 24/287
4,212,251 A * 7/1980 DiMartino ..... 24/287
4,626,155 A * 12/1986 Hlinsky et al. ..... 410/82
5,062,752 A * 11/1991 Takaguchi ..... 411/347
5,160,224 A * 11/1992 Schwiebert ..... 410/82
6,074,142 A * 6/2000 Schulz ..... 410/83

* cited by examiner

*Primary Examiner*—Robert J. Sandy
(74) *Attorney, Agent, or Firm*—Wenderoth, Lind & Ponack, L.L.P.

(57) ABSTRACT

A container coupling device is provided which can prevent displacement of an upper container and which is superior in durability. Upper and lower positioning protrusions provided integrally on top and bottom sides of a flange are inserted into engaging holes formed in corner fittings of upper and lower containers. The upper positioning protrusion is formed in the center of its top surface with a downwardly extending hole. A rotatable rotary shaft inserted in the hole has at its upper portion an engaging member which can engage the peripheral edge of the engaging hole of the corner fitting of the upper container. The upper and lower positioning protrusions are inserted in the engaging holes of the corner fittings of the upper and lower containers to prevent displacement of the upper and lower containers. The upper positioning protrusion, which is integral with the flange, bears a load due to inclination of the upper container. This improves durability of the container coupling device.

14 Claims, 7 Drawing Sheets

CONTAINER COUPLING DEVICE

BACKGROUND OF THE INVENTION

This invention relates to a container coupling device for preventing stacked containers from moving or being displaced in the back-and-forth and right-and-left directions.

Generally, in transporting many containers by ship, containers are stacked on hold floors or on the deck and upper and lower containers are coupled together by a container coupling device to prevent displacement of the containers.

Stacked containers have their outer peripheral corners guided by vertically extending guides, so that they have a relatively small tendency to incline in the vertical direction. Thus, upper and lower containers are coupled together by container coupling devices for preventing displacement in the back-and-forth and right-and-left directions.

As a container coupling device for preventing displacement of containers, one shown in FIGS. 6 and 7 is known. This container coupling device is integrally provided with a support shaft 22 on the top surface of a flange 21 arranged between upper and lower containers C1 and C2. An upper positioning protrusion 23 which is inserted into an engaging hole a1 formed in a bottom corner fitting A1 of the upper container C1 is provided so as to be rotatable about the support shaft 22. At the top end of the support shaft 22, an engaging member 24 is integrally provided and has its two ends engageable with the peripheral edge of the engaging hole a1 of the bottom corner fitting A1.

On the bottom surface of the flange 21, a lower positioning protrusion 25 is integrally provided and can be inserted into an engaging hole a2 formed in a top corner fitting A2 of the lower container C2.

To position containers using such container coupling devices, the position of the upper positioning protrusion 23 is adjusted so that the engaging member 24 is received within the outer periphery of the upper positioning protrusion 23 by rotating the upper positioning protrusion about the support shaft 22. Then, the upper positioning protrusion 23 is inserted into the engaging hole a1 in the bottom corner fitting A1 of the upper container C1, and both ends of the engaging member 24 are brought into engagement with the peripheral edge of the engaging hole a1 in the bottom corner fitting A1 by rotating the flange 21 relative to the upper positioning protrusion 23 to mount the container coupling device to the bottom surface of the upper container C1.

After mounting the container coupling device, the upper container C1 is stacked on the lower container C2 loaded beforehand to insert the lower positioning protrusion 25 into the engaging hole a2 in the top comer fitting A2 of the lower container C2, thereby preventing displacement of the upper and lower containers C1 and C2 by the engagement of the positioning protrusions 23 and 25 in the respective engaging holes a1 and a2.

In this conventional container coupling device, since the upper positioning protrusion 23, which is adapted to be inserted into the engaging hole a1 in the bottom comer fitting A1 of the upper container C1, is supported so as to be rotatable about the support shaft 22, if the upper container C1 inclines with the upper and lower containers C1 and C2 positioned by the container coupling device, a load will act on the support shaft 22.

Since the support shaft 22 extends through the positioning protrusion 23, there is a limit to an increase in the outer diameter of the support shaft 22. Since a load due to inclination of the upper container is borne by the support shaft 22, which is small in outer diameter and weak in the mechanical strength, there is a fear that the support shaft 22 may break. Thus one problem is poor durability.

Also, with the container coupling device mounted to the bottom corner fitting A1 of the upper container C1, since the engaging member 24, which engages the peripheral edge of the engaging hole a1 in the comer fitting A1, is pivotable relative to the upper positioning protrusion 23, when the upper container C1 is lowered to stack it on the lower container C2, if the lower positioning protrusion 25 abuts an obstacle and turning force is imparted thereto, there is a danger that the engaging member 24 will rotate out of engagement with the peripheral edge of the engaging hole a1 such that the container coupling device will fall.

An object of this invention is to improve durability and safety of a coupling device for preventing displacement of containers in the back-and-forth and right-and-left directions.

SUMMARY OF THE INVENTION

According to this invention, there is provided a container coupling device comprising a flange arranged between upper and lower containers, and positioning protrusions integrally provided on top and bottom surfaces of the flange for preventing displacement of the upper and lower containers in the back-and-forth and right-and-left directions by being inserted into engaging holes formed in opposed corners of the upper and lower containers. The upper positioning protrusion has in the center of its top surface a downwardly extending inserting hole. A rotary shaft is inserted in the inserting hole so as to be rotatably supported. An engaging member is provided on the top end of the rotary shaft so as to be engageable and disengageable relative to the peripheral edge of the engaging hole of the upper corner fitting. A turning amount limiting mechanism sets the turning range of the rotary shaft for rotation between an engaged position in which ends of the engaging member protrude outwardly from the sides of the upper positioning protrusion and a disengaged position in which the entire engaging member is received within the outer peripheral surface of the upper positioning protrusion.

By integrally providing the upper positioning protrusion on the flange, with the upper and lower containers positioned, if the upper container inclines, the load due to the inclination is borne by the upper positioning protrusion which is integral with the flange. Thus, it is possible to bear an extremely large load on the upper positioning protrusion, so that a coupling device superior in durability can be obtained.

Also, in a mounted state in which both ends of the engaging member engage the peripheral edge of the engaging hole formed in the bottom corner fitting of the upper container, during transfer for e.g. stacking the upper container, even if an obstacle collides against the lower positioning protrusion and a turning force is imparted to the coupling device, the engaging member will not turn in the disengaging direction. Thus, it is possible to avoid danger due to a fall of the coupling device.

Also, if a spring for imparting a turning force to the rotary shaft in such a direction that the engaging member engages the peripheral edge of the engaging hole is provided, by inserting the upper positioning protrusion into the engaging hole of the bottom corner fitting of the upper container and releasing the operating force for turning the rotary shaft, the engaging member will turn due to the resilience of the spring and its ends will automatically engage the peripheral edge of the engaging hole. Thus, it is possible to reliably mount the container coupling device to the bottom corner fitting in a short time.

As the turning amount limiting mechanism, a through hole communicating with the inserting hole is formed in the sides of the lower positioning protrusion, and a lever is mounted to the rotary shaft at a position opposite the through hole, thereby limiting the turning amount of the rotary shaft by the abutment of the lever on both inner peripheral sides of the through hole.

In the turning amount limiting mechanism, by forming the recesses which can accommodate the lever in both sides thereof, it is possible to prevent the lever from inadvertently turning even if the lever collides against an obstacle. Thus it is possible to reliably retain the engaging member in a position in which it engages the peripheral edge of the engaging hole and thus to further increase safety.

Other features and objects of the present invention will become apparent from the following description made with reference to the accompanying drawings, in which:

DETAILED DESCRIPTION OF THE PREFERRED EMBODIMENTS

Figure 1:
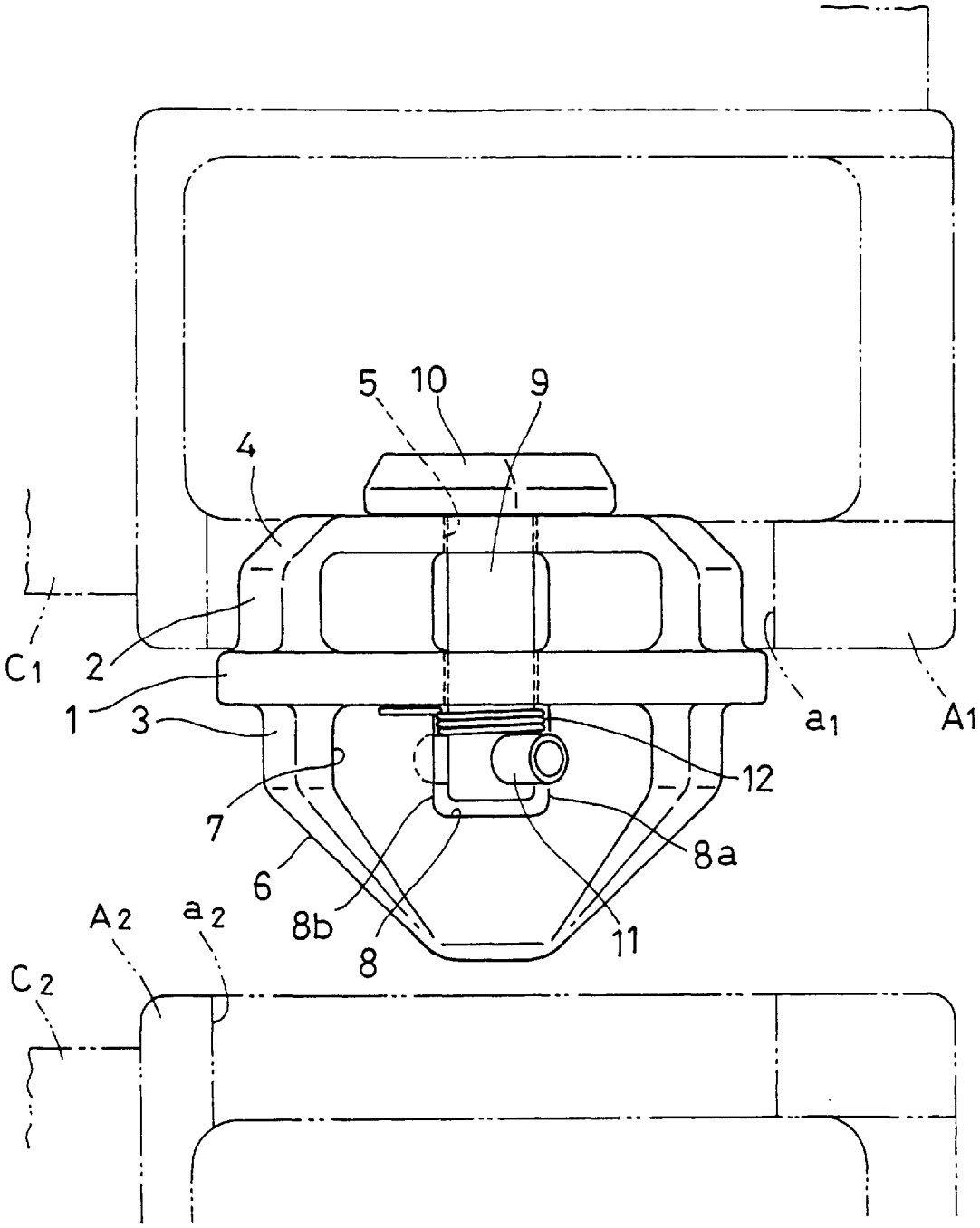
FIG. 1 is a front view showing an embodiment of the container coupling device according to this invention.
Figure 2:
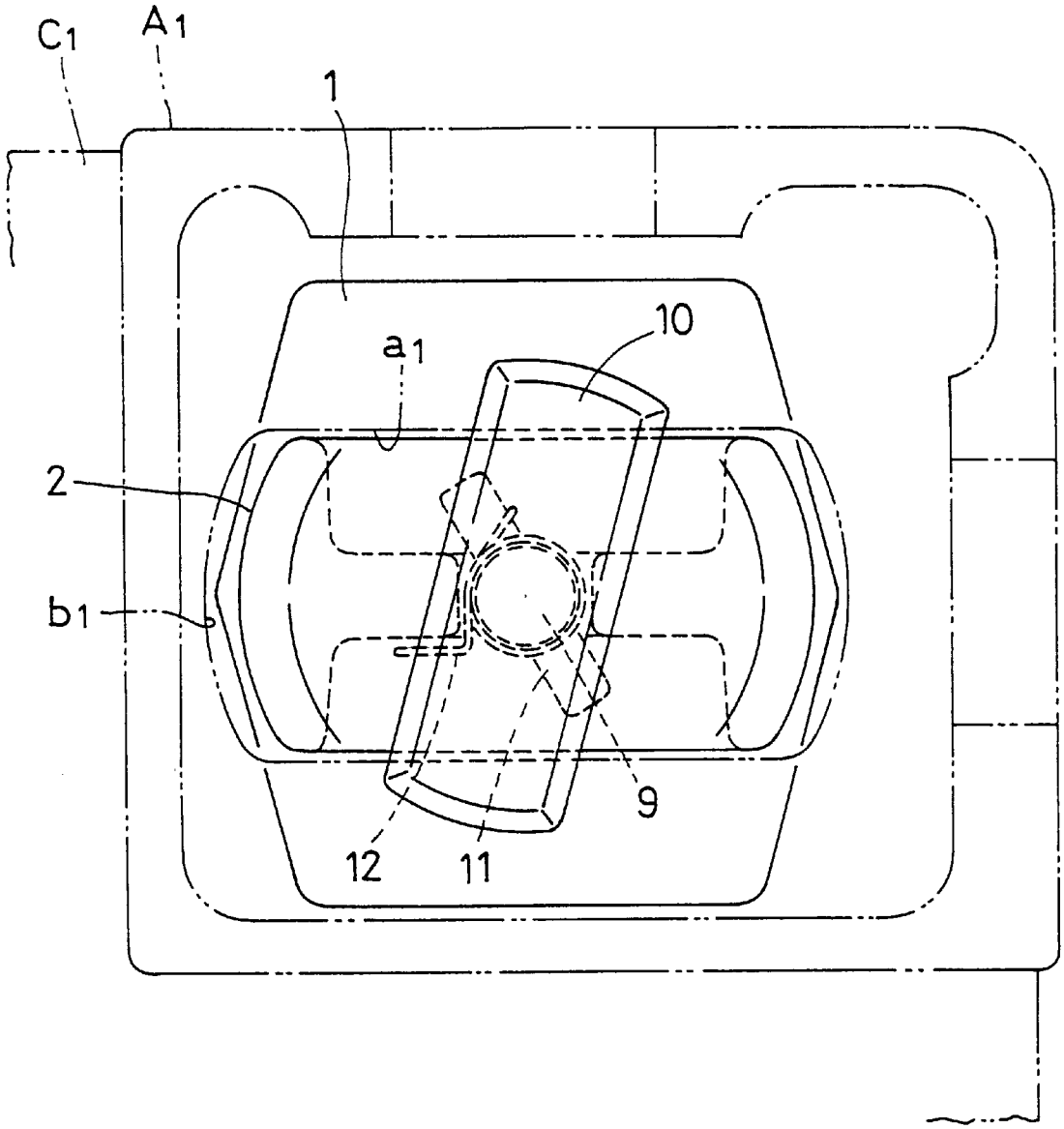
FIG. 2 is a plan view of the same.
Figure 3:
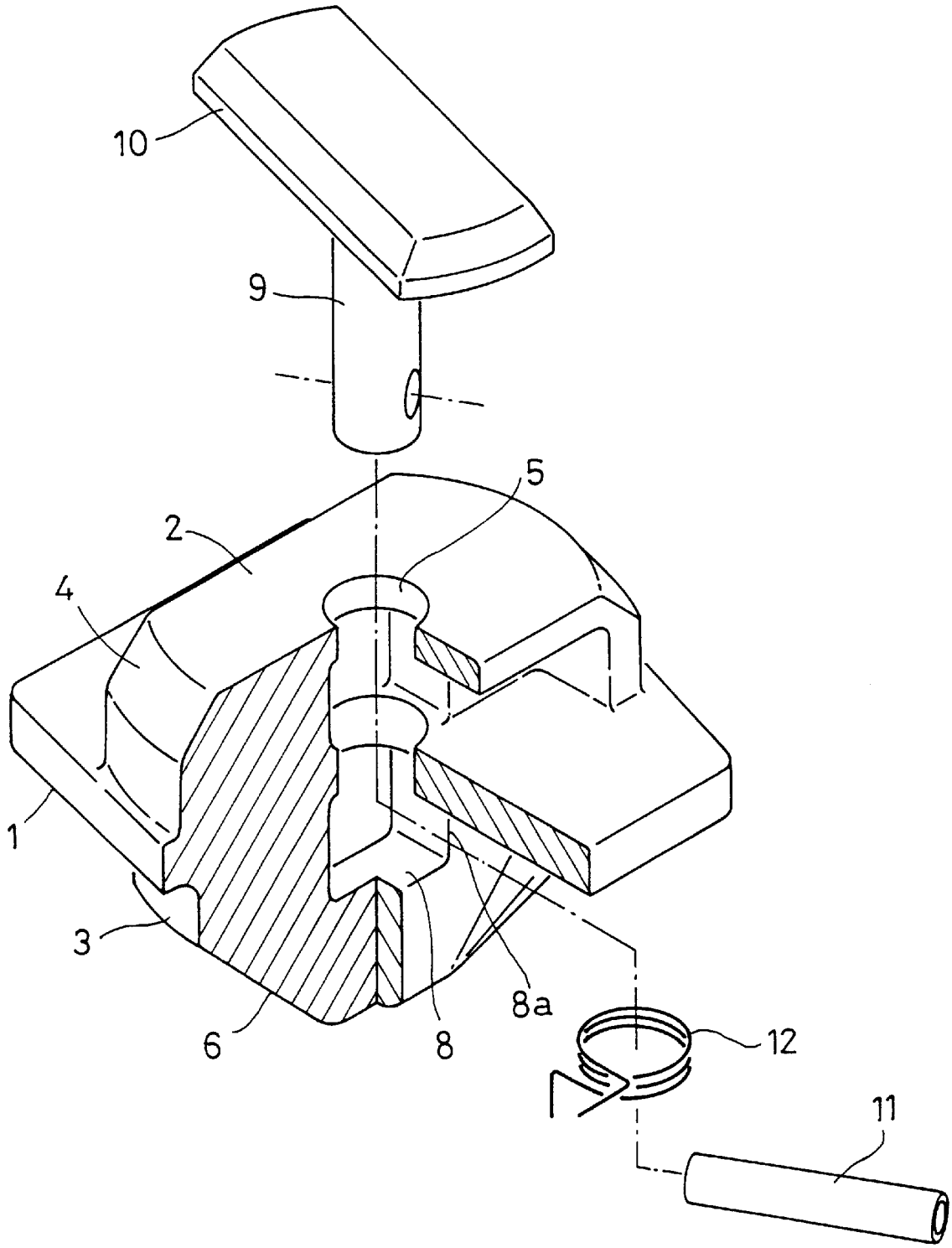
FIG. 3 is an exploded perspective view of the same.
Figure 4:
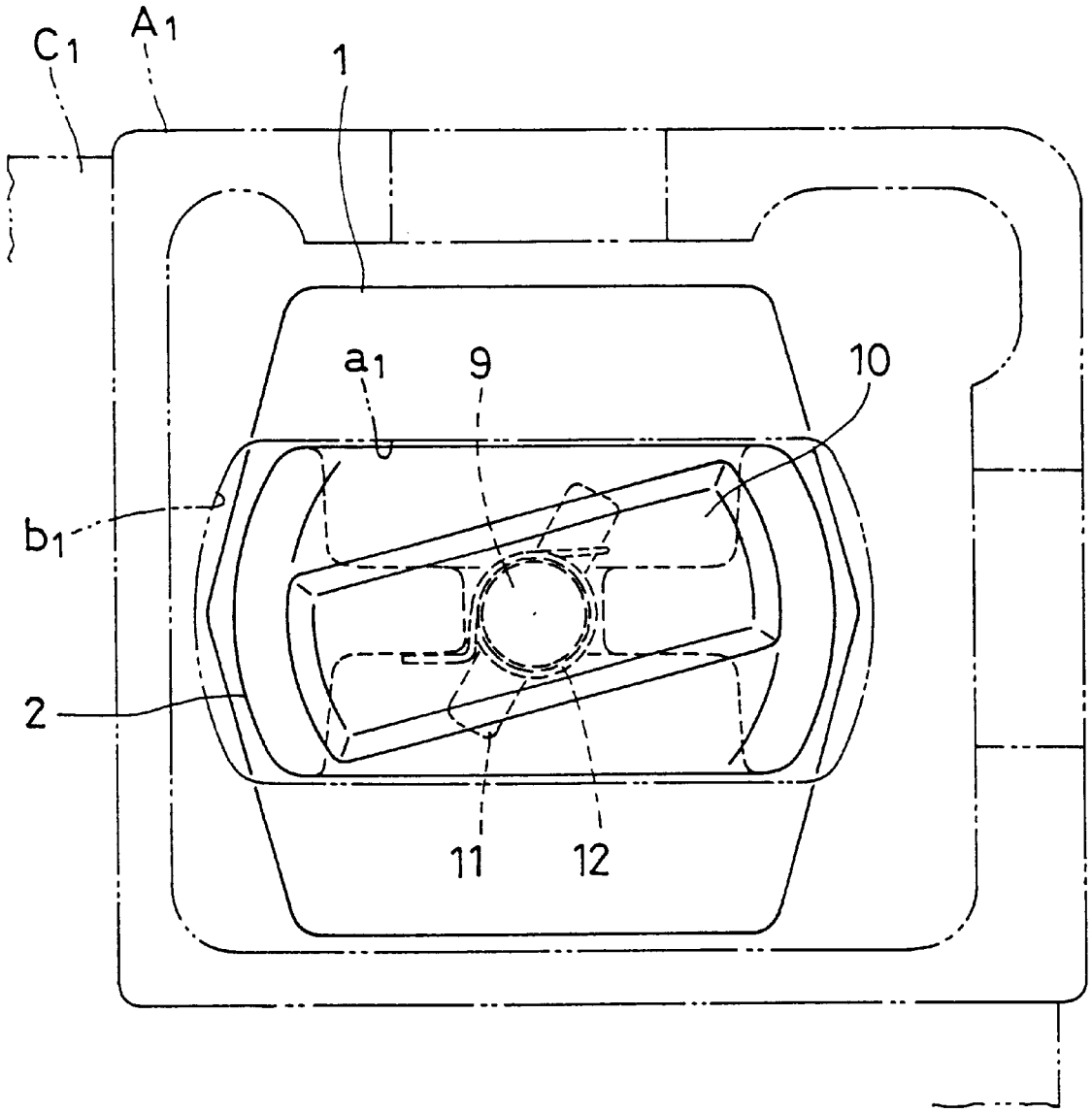
FIG. 4 is a plan view of the same showing the upper positioning protrusion inserted in an engaging hole.

Hereinbelow, the embodiments of this invention are described with reference to FIGS. 1–5. As shown in FIGS. 1–3, the container coupling device according to the present invention comprises a plate-like flange 1 and an upper positioning protrusion 2 and a lower positioning protrusion 3, both integral with the flange 1. The flange 1 is arranged between upper and lower containers C1 and C2. The upper positioning protrusion 2 and the lower positioning protrusion 3 are inserted into an engaging hole a1 formed in a bottom corner fitting A1 of the upper container C1 and an engaging hole a2 formed in a top corner fitting A2 of the lower container C2, respectively.

Here, the engaging hole a1 formed in the bottom corner fitting A1 is, as shown by chain line in FIG. 2, a hole elongated in the horizontal direction and has its two ends formed as arcuate surfaces b1. The upper positioning protrusion 2, which is adapted to be inserted into the engaging hole a1, has substantially the same cross-sectional shape as the engaging hole a1.

The engaging hole a2 formed in the top corner fitting A2 of the lower container C2 also has the same shape as the engaging hole a1 formed in the bottom corner fitting A1 of the upper container C1. The lower positioning protrusion 3 adapted to be inserted into the engaging hole a2 has substantially the same cross-sectional shape as the engaging hole a2.

At the top of both end faces of the upper positioning protrusion 2, tapered surfaces 4 are provided (FIG. 3). Also, in the upper positioning protrusion 2, a hole 5 extending downwardly from the center of the top surface is formed.

On the other hand, the lower positioning protrusion 3 has, at lower portions of its two end faces and both side faces, tapered surfaces 6 to facilitate insertion into the engaging hole a2 in the top corner fitting A2. Also, in both side faces of the lower positioning protrusion 3, recesses 7 are formed. Between the recesses 7, a through hole 8 is formed to communicate with the hole 5.

In the hole 5, a rotary shaft 9 is inserted and rotatably supported. At the top end of the rotary shaft 9, a plate-like engaging member 10 is provided. The engaging member 10 is of such a size as to be received within the outer periphery of the upper positioning protrusion 2, but with the length between the two ends thereof longer than the width between the two side faces of the upper positioning protrusion 2 (FIG. 2).

At a lower portion of the rotary shaft 9, at a position opposite the through hole 8, a lever 11 comprising a pin is provided. Until the lever 11 abuts either of the side walls of the hole 8, the rotary shaft 9 can pivot. With the lever 11 in abutment with one side wall 8*a* of the through hole 8, the engaging member 10 is in an engaged position in which its two ends protrude outwardly from both sides of the upper positioning protrusion 2 (FIG. 2). Also, with the lever 11 in abutment with the other side wall 8*b* of the through hole 8, the engaging member 10 is in a released or disengaged position in which it is received within the outer periphery of the upper positioning protrusion 2.

Also, on a lower portion of the rotary shaft 9, a spring 12 is supported. The spring 12 imparts a turning force to the rotary shaft 9 in such a direction that the lever 11 abuts the one side wall 8*a* of the through hole 8. Under the turning force, the engaging member 10 is held in the engaged state.

With the lever 11 abutting the one side wall of the through hole 8, it is of such a length as to be received in the recesses 7 formed in the two sides of the lower positioning protrusion 3.

The container coupling device shown by the embodiment is structured as described above. In positioning the vertically stacked containers C1 and C2, the container coupling device is firstly mounted to the bottom corner fitting A1 of the upper container C1 to be stacked. In mounting, the rotary shaft 9 is turned against the resilience of the spring 12 by pushing the lever 11 to bring the engaging member 10 into the released state in which it is received within the outer periphery of the upper positioning protrusion 2. Then the upper positioning protrusion 2 is inserted into the engaging hole a1 of the bottom corner fitting A1 of the upper container C1. With the flange 1 abutting the bottom corner fitting A1, the pressure on the lever 11 is released.

With the release of pressure on the lever 11, under the resilience of the spring 12, the rotary shaft 9 will turn in such a direction that the lever 11 abuts the one side wall 8*a* of the through hole 8. The rotation of the rotary shaft 9 brings the engaging member 10 into the engaged state with both ends of the engaging member 10 engaging the peripheral edge of the engaging hole a1, so that the container coupling device is mounted to the bottom corner fitting A1 of the upper container C1.

After mounting the container coupling device, the upper container C1 is loaded onto the lower container C2, which has been loaded beforehand on a ship, by inserting the lower positioning protrusion 3 into the engaging hole a2 in the top corner fitting A2 of the lower container C2.

With the upper and lower containers C1 and C2 coupled, since the upper and lower positioning protrusions 2 and 3 of the container coupling device are engaged in the engaging hole a1 of the bottom corner fitting A1 and the engaging hole a2 of the top corner fitting A2, respectively, displacement of the upper and lower containers C1 and C2 in any direction is prevented.

If the upper container C1 inclines due e.g. to rolling of the ship, a load will act on the upper positioning protrusion 2. At this time, since the upper positioning protrusion 2 is integral with the flange 1, the load applied by inclination of the upper container C1 is sufficiently borne by the upper positioning protrusion 2. Thus, there is no fear that the container coupling device will break.

As shown above, by imparting the resilient force of the spring 12 to the rotary shaft 9 in such a direction that the engaging member 10 engages, when the upper positioning protrusion 2 is inserted into the engaging hole a1 of the bottom corner fitting A1 and the pressure on the lever 11 is released, the resilient force of the spring 12 will turn the engaging member 10 in such a direction that its two ends engage the peripheral edge of the engaging hole a1. Thus it is possible to mount the container coupling device to the bottom corner fitting A1 in a short time.

Also, by providing the recesses 7 in which the lever 11 is received in the side faces of the lower positioning protrusion 3, during transfer such as stacking of the upper container C1, the lever 11 will not be pivoted by abutting an obstacle. Thus it is possible to prevent the rotary shaft 9 from being pivoted in such a direction that engagement is released. Thus, it is possible to reliably retain the container coupling device in an engaged state relative to the bottom corner fitting of the upper container C1 and thus to prevent danger due to a fall. Also, there will be no trouble in inserting and pulling of the lower positioning protrusion 3 into and out of the engaging hole a2 of the top corner fitting A2 of the lower container C2.

The mounting position of the lever 11 of the rotary shaft 9 is not limited to the position in this embodiment. For example, a lever inserting hole communicating with the hole 5 may be formed in one side of the outer periphery of the flange 1 to receive the lever 11.

Figure 5:
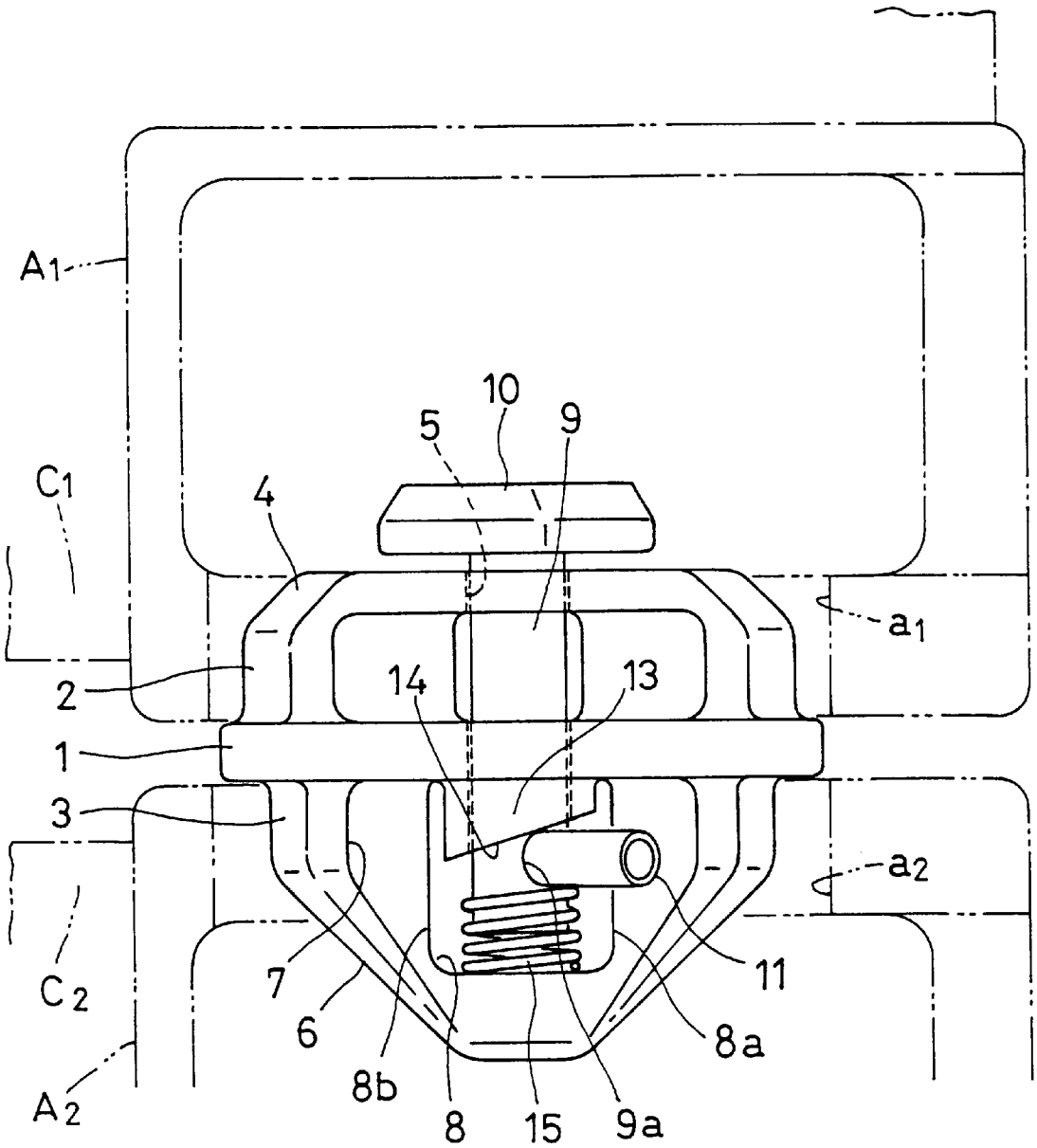
FIG. 5 is a front view showing another embodiment.
Figure 6:
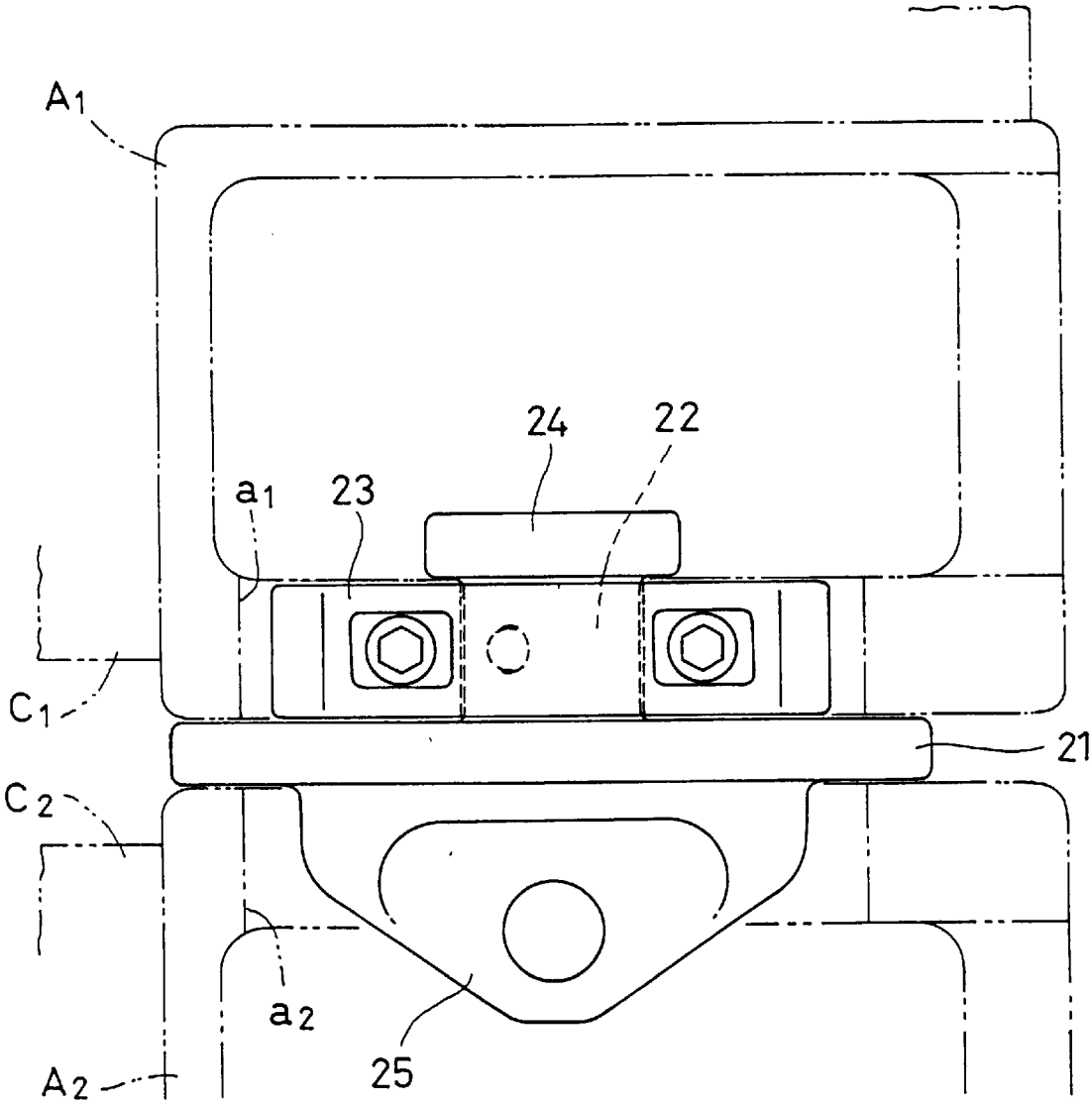
FIG. 6 PRIOR ART
FIG. 6 is a front view showing a conventional container coupling device.
Figure 7:
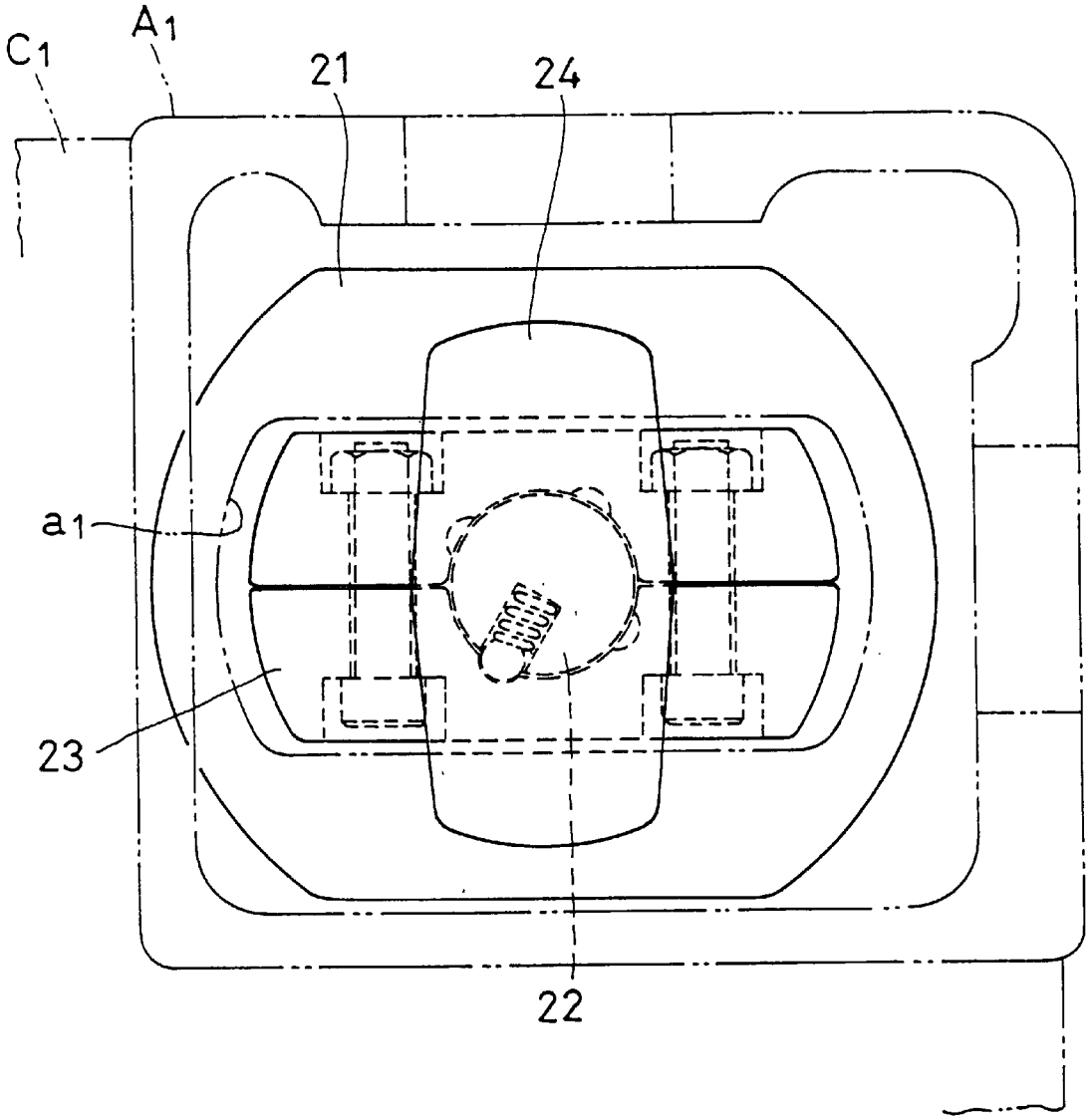
FIG. 7 PRIOR ART
FIG. 7 is a plan view of the same.

FIG. 5 shows another embodiment of the container coupling device according to this invention. In this embodiment, a projection 13 projecting into the through hole 8 is formed on the bottom surface of the flange 1. The bottom end face of the projection 13 is an inclined surface 14. A compression coil spring 15 is mounted in the through hole 8 to bias the rotary shaft 9 upwardly, thereby pressing the lever 11 on the rotary shaft 9 against the inclined surface 14.

Other structures are the same as those of the container coupling device shown in FIG. 1. Thus for the same parts, the same symbols are attached and their description is omitted.

In the container coupling device having the above structure, when the lever 11 is pivoted in such a direction as to abut the other side wall 8*b* of the through hole 8, since the lever moves along the inclined surface 14 of the projection 13, the rotary shaft 9 is lowered while being rotated. When the lever 11 abuts the other side wall of the through hole 8, the engaging member 10 is held in the released state in which it is received within the outer periphery of the upper positioning protrusion 2.

After the engaging member 10 has been brought into the released state, when the turning force on the lever 11 is released, the rotary shaft 9 will rotate back under the biasing force of the compression coil spring 15. Thus the engaging member 10 will move back to the engaged state in which the two ends thereof protrude outwardly from the two sides of the upper positioning protrusion 2.

In the engaged state of the engaging member 10, a gap is formed between the engaging member 10 and the top surface of the upper positioning protrusion 2. Thus, although within the range that the gap allows, the upper container C1 and the container coupling device can move relative to each other, since both ends of the engaging member 10 protrude outwardly from both sides of the upper positioning protrusion 2, the engaging member 10 will never come out of the engaging hole a1.

As described above, because the compression coil spring 15 is provided to press the lever 11 against the inclined surface 14 of the projection 13 by pushing the rotary shaft 9 up into the through hole 8, it is possible to assemble the container coupling device by mounting the compression coil spring 15 in the through hole 8, inserting the rotary shaft 9 from the top of the hole 5, and inserting the lever 11 into the lever-inserting hole 9*a* formed in the rotary shaft 9. Thus, assembly is easy.

As described above, according to this invention, by providing the upper positioning protrusion integral with the flange, it is possible for the device to bear a load due to inclination of the upper container on the upper positioning protrusion. Thus the container coupling device is less likely to break and superior in durability.

Also, since the spring for imparting a turning force to the rotary shaft in such a direction that the engaging member engages is provided, by inserting the upper positioning protrusion into the engaging hole of the bottom corner fitting of the upper container and releasing the force for turning the rotary shaft, the engaging member turns in the engaging direction so that both ends thereof engage the peripheral edge of the engaging hole. Thus, it is possible to easily and reliably mount the container coupling device to the bottom corner fitting.

Further, since the recesses for receiving the lever for turning the rotary shaft are formed in the sides of the lower positioning protrusion, it is possible to prevent the engaging member from turning in such a direction that engagement is released due to hitting of the lever against an obstacle during transfer of the upper container. Thus, it is possible to prevent danger due to a fall of the container coupling device and thus to improve safety.

What is claimed is:

1. A container coupling device comprising: a flange having top and bottom surfaces and being adapted to be arranged between upper and lower containers; upper and lower positioning protrusions integrally provided on said top and bottom surfaces of said flange, respectively, and adapted to be inserted into engaging holes formed in opposing parts of the upper and lower containers for preventing displacement of the upper and lower containers, said upper positioning protrusion having two sides, a top surface and a downwardly extending hole formed in said top surface of said upper positioning protrusion; a rotary shaft inserted in said downwardly extending hole and rotatably supported; an engaging member having two ends and being provided on a top end of said rotary shaft so as to be engageable and disengageable relative to the engaging hole of the upper container; and a turning amount limiting mechanism for allowing said rotary shaft to rotate between an engaged position in which said two ends of said engaging member protrude outwardly from said two sides of said upper positioning protrusion and a disengaged position in which said engaging member is entirely received within an outer periphery of said upper positioning protrusion; wherein said turning amount limiting mechanism comprises a through hole formed in said lower positioning protrusion so as to communicate with said downwardly extending hole, and a lever mounted to said rotary shaft at a position opposite said through hole, to thereby limit a rotation amount of said rotary shaft by abutment of said lever on inner peripheral sides of said through hole.

2. A container coupling device as claimed in claim 1, further comprising a spring for imparting a turning force to said rotary shaft in such a direction as to cause said engaging member to engage a peripheral edge of the engaging hole of the upper container.

3. A container coupling device as claimed in claim 1, wherein said lower positioning protrusion is formed with recesses in sides thereof to accommodate said lever.

4. A container coupling device as claimed in claim 1, wherein said downwardly extending hole has an upper end opening through said top surface of said upper positioning projection, and a lower end terminating at a position spaced above a bottom of said lower positioning projection.

5. A container coupling device comprising: a flange having top and bottom surfaces and being adapted to be arranged between upper and lower containers; upper and lower positioning protrusions integrally provided on said top and bottom surfaces of said flange, respectively, and adapted to be inserted into engaging holes formed in opposing parts of the upper and lower containers for preventing displacement of the upper and lower containers, said upper positioning protrusion having two sides, a top surface and a downwardly extending hole formed in said top surface of said upper positioning protrusion; a rotary shaft inserted in said downwardly extending hole and rotatably supported; an engaging member having two ends and being provided on a top end of said rotary shaft so as to be engageable and disengageable relative to the engaging hole of the upper container; and a turning amount limiting mechanism for allowing said rotary shaft to rotate between an engaged position in which said two ends of said engaging member protrude outwardly from said two sides of said upper positioning protrusion and a disengaged position in which said engaging member is entirely received within an outer periphery of said upper positioning protrusion; wherein a bottom end of said rotary shaft is devoid of any engaging member that is fixed for rotation with said rotary shaft so as to be rotatable to an engaging position at which ends thereof protrude outwardly from sides of said lower positioning protrusion.

6. A container coupling device as claimed in claim 5, wherein said turning amount limiting mechanism comprises a through hole formed in said lower positioning protrusion so as to communicate with said downwardly extending hole, and a lever mounted to said rotary shaft at a position opposite said through hole, to thereby limit a rotation amount of said rotary shaft by abutment of said lever on inner peripheral sides of said through hole.

7. A container coupling device as claimed in claim 5, wherein said downwardly extending hole has an upper end opening through said top surface of said upper positioning projection, and a lower end terminating at a position spaced above a bottom of said lower positioning projection.

8. A container coupling device as claimed in claim 5, further comprising a spring for imparting a turning force to said rotary shaft in such a direction as to cause said engaging member to engage a peripheral edge of the engaging hole of the upper container.

9. A container coupling device as claimed in claim 5, wherein said lower positioning protrusion is formed with recesses in sides thereof to accommodate said lever.

10. A container coupling device comprising: a flange having top and bottom surfaces and being adapted to be arranged between upper and lower containers; upper and lower positioning protrusions integrally provided on said top and bottom surfaces of said flange, respectively, and adapted to be inserted into engaging holes formed in opposing parts of the upper and lower containers for preventing displacement of the upper and lower containers, said upper positioning protrusion having two sides, a top surface and a downwardly extending hole formed in said top surface of said upper positioning protrusion; a rotary shaft inserted in said downwardly extending hole and rotatably supported; an engaging member having two ends and being provided on a top end of said rotary shaft so as to be engageable and disengageable relative to the engaging hole of the upper container; and a turning amount limiting mechanism for allowing said rotary shaft to rotate between an engaged position in which said two ends of said engaging member protrude outwardly from said two sides of said upper positioning protrusion and a disengaged position in which said engaging member is entirely received within an outer periphery of said upper positioning protrusion; wherein said turning amount limiting mechanism comprises a lever extending outwardly from said rotary shaft; and wherein said lever is arranged such that, when said upper and lower positioning protrusions are respectively engaged in the engaging holes of the upper and lower containers, said lever is inaccessible outside of the engaging holes.

11. A container coupling device as claimed in claim 10, wherein said downwardly extending hole has an upper end opening through said top surface of said upper positioning projection, and a lower end terminating at a position spaced above a bottom of said lower positioning projection.

12. A container coupling device as claimed in claim 10, further comprising a spring for imparting a turning force to said rotary shaft in such a direction as to cause said engaging member to engage a peripheral edge of the engaging hole of the upper container.

13. A container coupling device as claimed in claim 10, wherein said lower positioning protrusion is formed with recesses in sides thereof to accommodate said lever.

14. A container coupling device as claimed in claim 10, wherein said turning amount limiting mechanism comprises a through hole formed in said lower positioning protrusion so as to communicate with said downwardly extending hole, and a lever mounted to said rotary shaft at a position opposite said through hole, to thereby limit a rotation amount of said rotary shaft by abutment of said lever on inner peripheral sides of said through hole.

* * * * *